United States Patent [19]

Mio et al.

[11] Patent Number: 4,536,645

[45] Date of Patent: Aug. 20, 1985

[54] SOLID-BODY HEATING UNIT

[75] Inventors: Mitsushi Mio, Sumoto, Japan; Hisao Negita, 11-31-202, Hikarigaoka, Hiroshima City, Hiroshima Prefecture, Japan

[73] Assignees: Awaji Sangyo Kabushiki Kaisha, Sumitomo; Hisao Negita, Hiroshima, both of Japan

[21] Appl. No.: 599,829

[22] Filed: Apr. 13, 1984

[30] Foreign Application Priority Data

Apr. 15, 1983 [JP] Japan ..... 58-65217

[51] Int. Cl.[3] ..... H05B 3/16

[52] U.S. Cl. ..... 219/543; 219/216; 219/464; 338/217; 338/309; 427/122; 427/126.2

[58] Field of Search ..... 219/213, 203, 345, 464, 219/541, 543, 521, 522, 216; 338/217, 308, 309, 333; 427/122, 123, 164, 126.1, 126.2

[56] References Cited

U.S. PATENT DOCUMENTS

| | | | |
|---|---|---|---|
| 2,569,773 | 10/1951 | Orr | 338/217 X |
| 3,330,942 | 7/1967 | Whitson | 219/522 |
| 3,591,753 | 7/1971 | Gartner | 219/464 |
| 3,978,316 | 8/1976 | Rose et al. | 219/543 |
| 4,002,883 | 1/1977 | Hurko | 219/543 |
| 4,063,068 | 12/1977 | Johnson et al. | 219/543 X |
| 4,203,025 | 5/1980 | Nakatami et al. | 219/216 |
| 4,259,564 | 3/1981 | Ohkubo et al. | 219/543 X |
| 4,278,875 | 7/1981 | Bain | 219/522 |
| 4,367,398 | 1/1983 | Strube et al. | 219/543 X |
| 4,382,177 | 5/1983 | Heaney | 219/522 |

*Primary Examiner*—Volodymyr Y. Mayewsky
*Attorney, Agent, or Firm*—Wenderoth, Lind & Ponack

[57] ABSTRACT

A solid-body heating unit used for the warmth preservation, heating and heat treatment, more particularly, for surface heater for plates or patterns, has a refractory base overlaid with an electroconductive layer, a protective layer overlaying the electroconductive layer and a power supply for passing electric current through the electroconductive layer, whereby the surface temperature of the plates or patterns is controllable.

2 Claims, 3 Drawing Figures

SOLID-BODY HEATING UNIT

BACKGROUND OF THE INVENTION

1. Field of the Invention

The present invention relates to a solid-body heating unit, and more particularly, to a solid-body heating unit for preserving warmth, heating, melting, and heat treating, and which is suitable for use with plate or pattern capable of controlling surface temperature therein.

2. Description of the Prior Art

Conventional warmth preserving and heat producing units utilize heating elements of various forms; rod, wire, coil, filament, etc. These heating elements are spaced at intervals ranging from a few mm to a few cm and have thicknesses on a like other. As a result the temperature between the individual elements is low and the temperature distribution of the unit is not uniform. Wide sheet-like heating units have not been available for a practical application.

SUMMARY OF THE INVENTION

The present invention provides a solid-body heating unit comprising a body in the form of a sheet of wood, plastic or ceramic covered with an electroconductive layer on the surface thereof.

In addition, the present invention provides a solid-body heating unit capable of controlling surface temperature, fabricated by coating the surface of a mask or pattern of desired configuration with an electroconductive layer.

BRIEF DESCRIPTION OF THE DRAWINGS

Other and further objects of the invention will become apparent to those skilled in the art from the following description with reference to the annexed sheet of the drawings, in which.

DETAILED DESCRIPTION OF THE INVENTION

Figure 1:
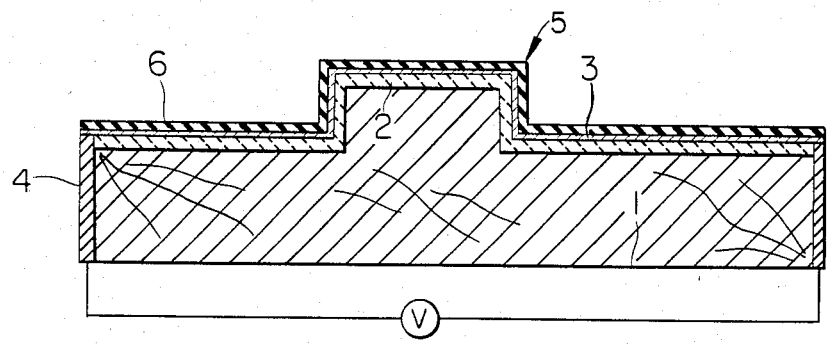
FIG. 1 is a sectional elevation view of the heating unit of the present invention taken on line 1—1 of FIG. 2.
Figure 2:
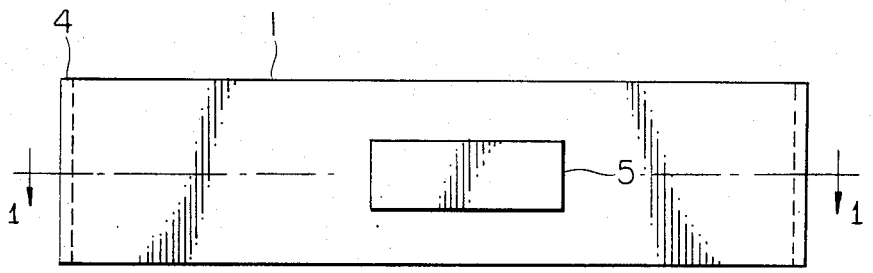
FIG. 2 is a plan view of the heat unit of the present invention.

The solid-body heating unit of the present invention comprises a solid-body structure having a 15 to 1,000$\mu$ thick electroconductive layer closely adhered thereon. If necessary, the thickness of the electroconductive layer is varied locally to control the electrical resistance of the layer, thereby to achieve a desired temperature distribution.

When wood or plastic is used for the solid-body structure, the surface of the solid-body structure is provided with a refractory heat-insulating ceramic layer which is in turn covered with an electroconductive material such as an alloy or a compound or a reformed carbonaceous material having characteristics similar to such an alloy or a compound. The thickness of the electroconductive layer is suitably 15 to 1,000$\mu$, with the regions requiring higher resistivity being given greater thickness.

Generally speaking, a material that has a large positive temperature coefficient of resistivity gives rise to little biased or concentrated current so that a stable distribution of temperature can easily be obtained. In other words, in the present invention, an electroconductive layer material which increases in resistivity with rising temperature is most preferred. A layer material having a resistivity of 30–30,000 $\mu\Omega$cm is used.

If the resistivity is less than 30 $\mu\Omega$cm, the layer generates little heat while if it is more than 30,000 $\mu\Omega$cm, a high voltage is required. In either case, the layer is not suitable for practical application.

By experiment it was found that the resistivity of alloys such as those of Mo.Si, Ti.Si, Ni-Cr system, Fe-Cr-Al system or reformed carbon increases proportionally with temperature increase, making them preferable for use in the heating units of this invention.

A thin electroconductive layer can easily be formed by using an electroconductive material consisting of very fine particles, and by using a plasma arc to deposit the layer it is possible to obtain an electroconductive layer having a large contact resistance between the particles thereof. The electroconductive layer of this invention is preferably formed by spraying, although it is also possible to form the layer by use of a binder.

In the drawings, a sheet-like base 1, here shown as wood is provided with a refractory layer 2 of, for example, zirconia, zircon, alumina or chamotte and an electroconductive layer 3 is provided on the refractory layer. The electroconductive layer may be formed by spraying a Ti.Si alloy, for example. Reformed carbon may be used for painting layer. Reference numeral 4 denotes a metal terminal and a reference numeral 5 denotes a convex portion.

The electroconductive layer 3 is covered with an electrically insulative protective layer 6 to protect the user from electric shock. The electrically insulative protective layer is preferred to be of silicone resin or alumina. Although the drawings show the use of a sheet-like base, it is of course possible to use a box-like refractory base set up in sheet-like heating units. The shape of the base may be flat or curved.

As the present invention does not use rod, wire, coil or filament heating elements but instead uses a thin electroconductive layer provided on a solid sheet-like body, the heating element is virtually unnoticeable and can be made so thin as to be negligible as a dimensional factor. Use of such a thin, electroconductive layer facilitates the fablication of a solid-body structure capable of providing warming and heating functions. Moreover, with the solid-body heating unit of this invention there is no danger of local regions becoming overheated to the point that they become red hot as frequently occurs in conventional heating units using rod or wire heating elements. To the contrary, the heating unit of this invention makes it possible to reliably obtain a uniform temperature distribution continuously.

Solid-body heating unit of this invention can be effectively used for the purpose of hardening sand molds and drying mold wash. Namely, this invention makes possible fabrication of a mask or pattern capable of controlling surface temperature therein by forming an electroconductive layer on a wooden or plastic pattern over a refractory heat-insulating layer.

EXAMPLE 1

A zirconia layer was formed on the surface of a Japanese cypress board (50 cm$\times$10 cm$\times$3 cm) and a 50$\mu$ thick layer of a Ti.Si alloy was formed thereon. As the existence of a protruding portion resulted in a longer electrical path, the thickness of the spray-deposited layer was increased.

When an electric voltage of 10 V was applied across the terminals of the electroconductive layer, a stable surface temperature of 30° C. was obtained. A protective layer of silicon resin was applied over the whole surface of the deposited electroconductive layer to a thickness of 10μ, thus eliminating any danger of electrical shock to the user.

EXAMPLE 2

A 70μ thick layer of a Mo.Si alloy was spray-deposited on the surface of a flat chamotte refractory plate (30 cm×20 cm×2 cm) and covered with a 0.5 mm thick protective layer of alumina.

When 40 V was applied across the terminals of the electroconductive layer, a uniform surface temperature of 256° C. was obtained. No red heat spots like those frequently encountered in heating units employing rod, wire, coil or filament heating elements were observed.

EXAMPLE 3

A thin layer of reformed carbon was provided on the surface of a chamotte refractory plate (30 cm×30 cm×2 cm) to a thickness of 400μ in all regions except the edges where the layer was made 900μ thick. The entire thin layer was covered with an alumina material to a thickness of 100μ. When 60 V was applied across the terminals of the carbonaceous layer, the units had a temperature of 210° C. at the peripheral region and of 100° C. at the middle region thereof.

Figure 3:
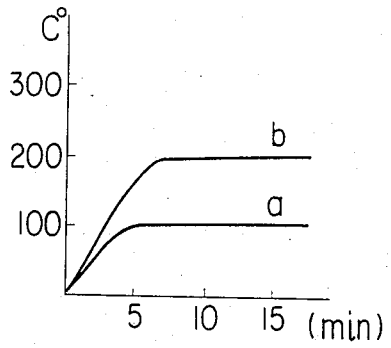
FIG. 3 is a graph showing surface temperature distribution in a solid-body heating unit.

FIG. 3 is a graph showing the temperature change with time of the middle region (a) and of the peripheral region (b).

We claim:

1. A mold pattern for casting metal, comprising:

a refractory mold pattern base having the pattern to be molded on the face thereof;

an electroconductive layer on said face and conforming to the shape of said pattern, said layer being 15–1000μ thick and being of an electroconductive material selected from the group consisting of Mo-Si alloy, Ti-Si alloy, Ni-Cr alloy, Fe-Cr-Al alloy, and reformed carbon, said material having a resistivity of 30–30,000 μΩcm; the layer having a larger thickness at portions at which a higher temperature is desired and having a smaller thickness at portions at which a lower temperature is desired; and terminal means connected to said layer for passing electric current through said layer, whereby the heating temperature produced by said layer can be made different in different regions of the face of the pattern.

2. A mold pattern as claimed in claim 1 in which the layer is of reformed carbon, and the central region of the layer is 400μ thick and the peripheral region of the layer is 900μ thick, whereby the heating temperature produced by said layer can be made higher in the peripheral region than in the central region.

* * * * *